US005163241A

United States Patent [19]

Blaeser et al.

[11] Patent Number: 5,163,241

[45] Date of Patent: Nov. 17, 1992

[54] DISPLAY BOARD AND MODULES THEREFOR

[75] Inventors: Henry P. Blaeser, Dayton; Gene L. Hosler, Germantown, both of Ohio

[73] Assignee: Blaeser Engineering Services, Inc., Dayton, Ohio

[21] Appl. No.: 316,120

[22] Filed: Feb. 24, 1989

[51] Int. Cl.[5] ..... G09F 7/04

[52] U.S. Cl. ..... 40/600; 40/615

[58] Field of Search ..... 40/600, 618, 620, 489, 40/452, 615; 273/157 R; 33/1 G

[56] References Cited

U.S. PATENT DOCUMENTS

| | | | |
|---|---|---|---|
| 2,764,751 | 9/1956 | Gnadke | 40/576 |
| 2,804,607 | 8/1957 | Nalle, Jr. | 40/618 |
| 2,816,380 | 12/1957 | Sindell | 40/620 |
| 2,958,948 | 11/1960 | Dunkelberger | 33/1 G |
| 3,447,249 | 6/1969 | Greger | 40/621 |
| 3,987,558 | 10/1976 | Tsukamoto | 273/157 R |
| 4,074,452 | 2/1978 | Bellinder | 40/573 |
| 4,258,920 | 3/1981 | Waldron et al. | 273/157 R |
| 4,505,061 | 3/1985 | Neuburger et al. | 40/489 |
| 4,942,275 | 7/1990 | Addy et al. | 40/621 X |

FOREIGN PATENT DOCUMENTS

| | | | |
|---|---|---|---|
| 770860 | 11/1967 | Canada | 434/430 |
| 2919643 | 11/1979 | Fed. Rep. of Germany | 40/452 |

*Primary Examiner*—Kenneth J. Dorner
*Assistant Examiner*—Brian K. Green
*Attorney, Agent, or Firm*—Biebel & French

[57] ABSTRACT

A display board for illustrating an electrical power distribution system or the like comprises a matrix of rectangular modules magnetically attached to a steel support board. The modules may comprise die cut steel base plates backed by sheets of magnetic rubber. Relatively permanent background graphics are silk screened upon the front faces of the modules. Foreground graphics representing features which are subject to change may be overprinted upon the background graphics in an ink which may be removed without disturbing the background graphics.

15 Claims, 5 Drawing Sheets

DISPLAY BOARD AND MODULES THEREFOR

BACKGROUND OF THE INVENTION

This invention relates to display boards such as boards of the type used by electrical power companies to display representations of power lines and switches on a map of the territory. Prior art display boards of this particular type have been relatively expensive, difficult to update, or of poor graphic quality.

One prior art system utilizes plastic squares or tiles that are mechanically snapped into special frames to form a graphic mosaic. These tiles are typically 1" square. Standard graphics and symbols are applied to each square by etching, silk screening or other convenient technique, and the tiles are selected and assembled to form the desired image. Thousands of such tiles are required in a typical display board. Thus the board is generally used to depict transmission or distribution systems in a schematic format rather than a geographic format, which requires a resolution not easily achieved by such tiles. Lamp tiles incorporating light emitting devices have been used for producing special effects on such prior art display boards.

Another prior art display board used for representing electrical power distribution systems comprises a steel peg board painted to represent a geographical background. Power distribution equipment is represented by applying pieces and strips of tape to the painted board.

Display boards are well-known outside the electrical power industry and have many applications as for instance in personnel training courses, process control and railway switching. Such prior art displays are commonly printed on a large translucent plastic sheet which may be backlighted as taught by Koch, U.S. Pat. No. 3,608,222. Graphics for such a display have been painted directly on the front face of a panel board or on a subpanel which is subsequently mounted onto the panel board. Silk screening has been employed to improve the straightness and sharpness of lines but has been thought to be prohibitively expensive. For an overview of graphic systems as applied to process instrumentation, reference may be made to an article by Allen Devrishian entitled Graphic System Techniques, Instruments And Control Systems, Vol. 34, pages 1458–1461, August, 1961.

SUMMARY OF THE INVENTION

This invention provides an improved display board wherein a matrix of display modules are fitted together to collectively portray an overall graphic display. In one aspect of the invention the modules carry two printed patterns. The first printed pattern defines relatively permanent background features, and these features are printed in a relatively permanent ink or paint. The second pattern defines foreground features which are subject to change, and these features are printed in an ink or paint which is relatively easy to remove. The printed patterns are preferably applied to the modules by a silk screening process. Silk screening may be achieved conveniently with the modules assembled in place on an assembly board. Thereafter the modules may be shipped to a work site where they are mounted on a support board. Preferably each module comprises a steel base plate and a flexible magnetic rubber backing sheet adhered to the rear surface thereof. When the modules are constructed in this manner, the support board conveniently may comprise a sheet of steel mounted on a suitable frame. The modules are magnetically attached to the support board in closely interfitted relationship. At least some of the modules are surrounded by and completely contiguous with other modules.

In another aspect of the invention, a plurality of rectangular modules collectively display an electrical power distribution system and are fitted together on a support board with light emitting diodes mounted thereon to represent switches in the network. The light emitting diodes extend through aligned apertures in the support board and the modules.

The method of producing the modules preferably commences with producing a first photographic transparency representing background features of interest and a second photographic transparency representing foreground features of interest. The first and second photographic transparencies are exposed to produce first and second silk screens respectively. An array of congruent rectangular modules are then secured in place on an assembly board and subjected to a two-step silk screening process. In the first step, the first silk screen is used for printing the background features in a relatively permanent ink or paint. In the second step, the second silk screen is used for overprinting a representation of foreground features in an ink or paint which may be removed without disturbing the underlying image.

It is therefore an object of this invention to provide a display board which portrays graphic features at a relatively high resolution.

It is another object of this invention to provide a display board which may be readily modified to reflect changes in the information appearing thereon.

It is yet another object of the invention to provide a high-quality illuminated board for displaying utility transmission and distribution systems.

Other objects and advantages of the invention will be apparent from the following description, the accompanying drawings and the appended claims.

DESCRIPTION OF THE PREFERRED EMBODIMENT

Figure 1:
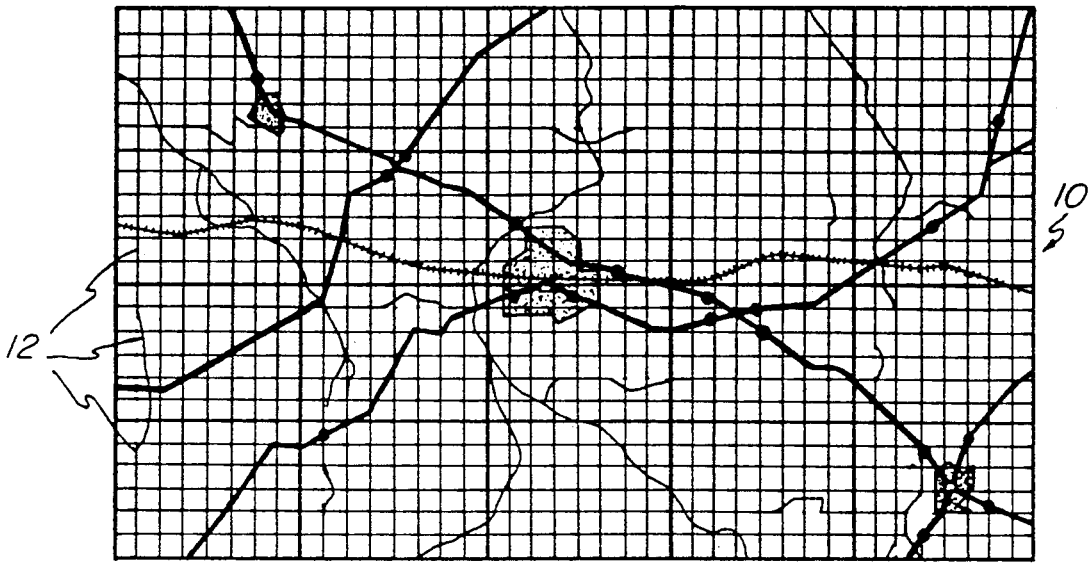
FIG. 1 is a front elevation view of a display board.
Figure 4:
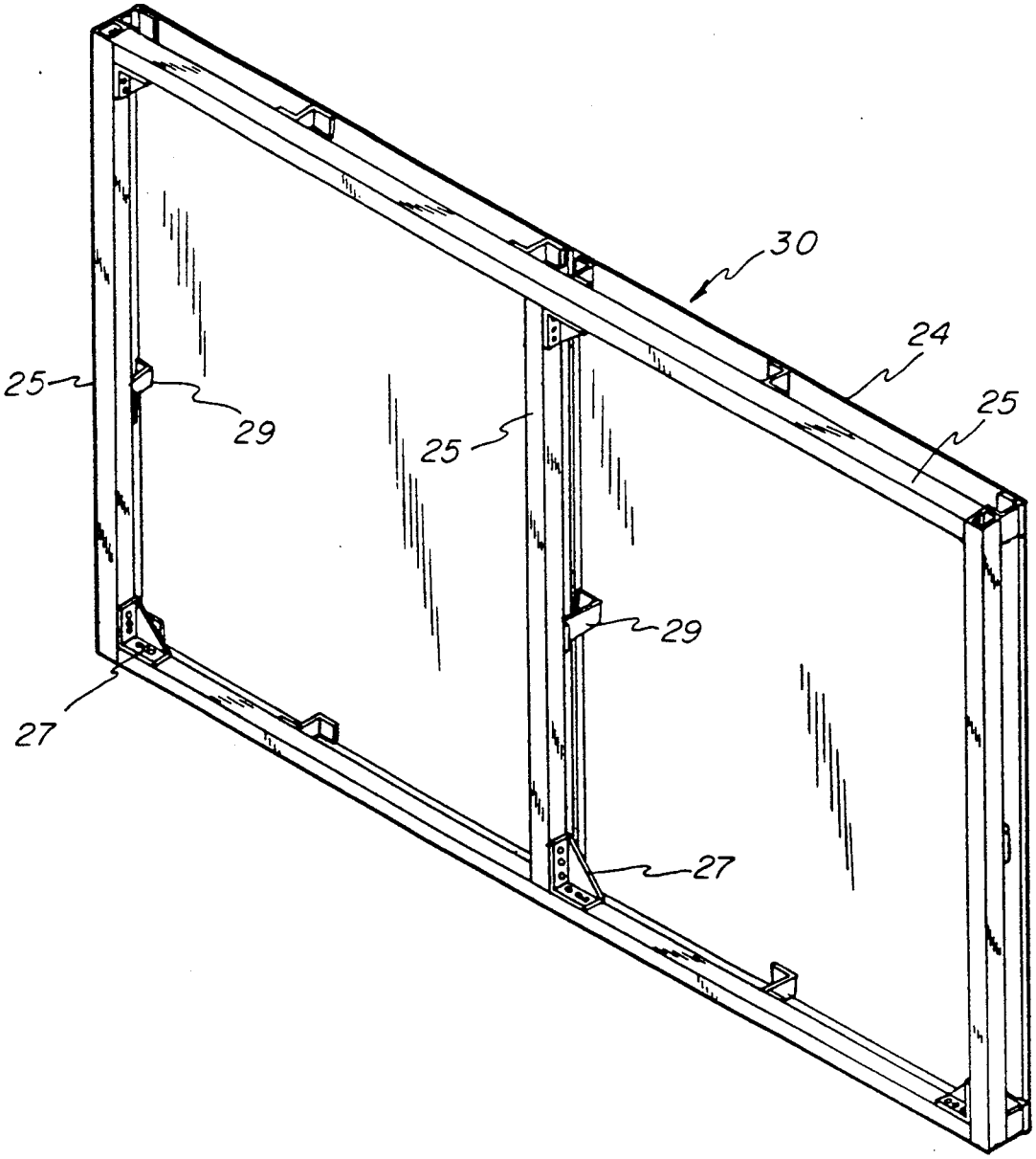
FIG. 4 is a perspective view of a mounting frame.

A display board 10 in accordance with this invention may be constructed as generally illustrated in FIG. 1. Such a display board may comprise a matrix of display modules 12 fitted together in adjoining relationship and mounted on a support board 24 secured to a frame 30 (FIG. 4). Each of modules 12 is imprinted with graphic information, and the modules when assembled collectively display an image such as a map of an electrical power distribution system. It will be seen that at least some of modules 12 are peripherally surrounded by and completely contiguous with others of the modules. That is, all portions of the boundaries of those modules are touching some portion of the boundary of another module. The graphical information on the individual modules may be applied in stages as hereinafter described.

Figure 2:
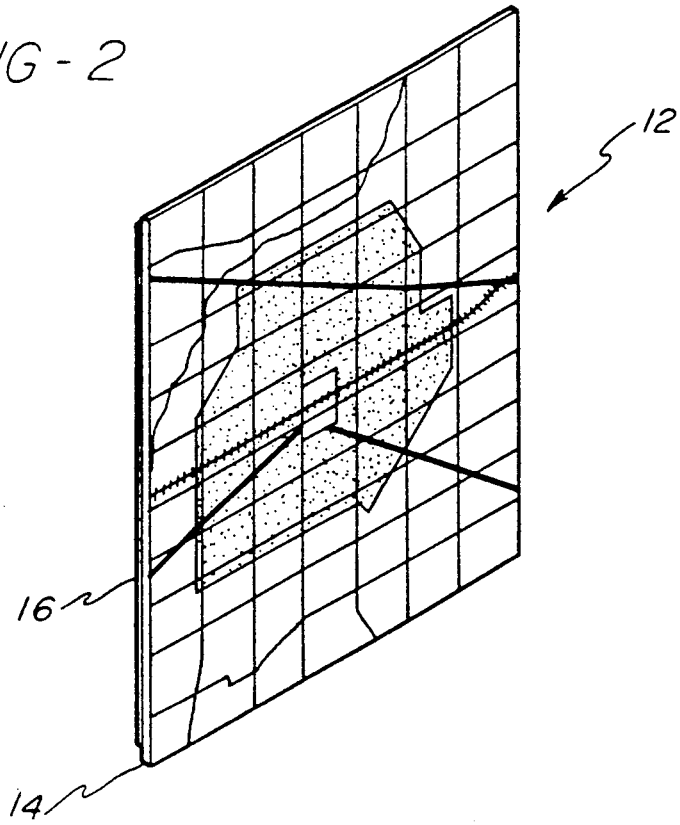
FIG. 2 is a perspective view of a display module.
Figure 3:
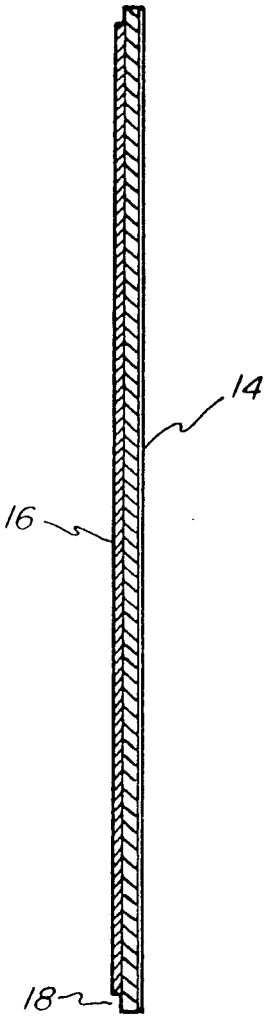
FIG. 3 is a cross-sectional view of a display module.

As illustrated in FIGS. 2 and 3, a module 12 may comprise a steel base plate 14 and a flexible magnetic rubber backing sheet 16. Base plate 14 conveniently may be fabricated from 24-gauge cold rolled steel sheet but may be thinner if additional flexibility is desired for conformance to a curved support board. The steel sheet is preferably galvanized and is die-cut to produce module base plates 14 of precise rectangular dimensions. Base plates 14 conveniently may be congruent rectangles about 8½"×11" in size. Prior to assembly of modules 12, base plates 14 may be precoated with a waterborne polyester enamel. This coating may be sprayed on the galvanized base plates and thereafter baked in the conventional manner. Alternatively, a two-part polyurethane enamel may be sprayed or screened on the galvanized base plates. Backing sheet 16 may be of the readily available commercial type comprising synthetic rubber filled with magnetic particles and is cut to a rectangular shape slightly smaller than base plate 14. Backing sheet 16 is adhesively attached to the rear surface of base plate 14 to define an overhang 18 on all four sides. Overhang 18 may be about 1/16" wide. This accommodates differential thermal expansion between backing sheet 16 and base plate 14 and affords a fingernail entry space to facilitate separation of module 12 from support board 24.

Frame 30 may be constructed from a series of channels 25, angle fittings 27 and Z brackets 29, as illustrated in FIG. 4. Preferably support board 24 is secured to the front face of frame 30 for reception of modules 12. Support board 24 is preferably fabricated from cold rolled steel so as to provide a strong magnetic attraction for modules 12. Support board 24 may be fastened to frame 30 by hinges, or it may be permanently secured thereto by other means. However, frame 30 is not essential, as support board 24 may be secured to an existing wall surface. Alternatively, modules 12 may be overlaid upon the surface of an existing ferrous mapboard.

While display boards in accordance with this invention may have a variety of applications, they are particularly useful for displaying maps of electrical power distribution systems, as illustrated in FIG. 1. For this particular application it is necessary to provide high quality graphics. That is achieved, in part, by accurately die cutting base plates 14 to provide a tightly fitting matrix of modules 12. Additionally, the graphics may be applied by a silk screening process, as generally illustrated by FIG. 9.

Figure 9:
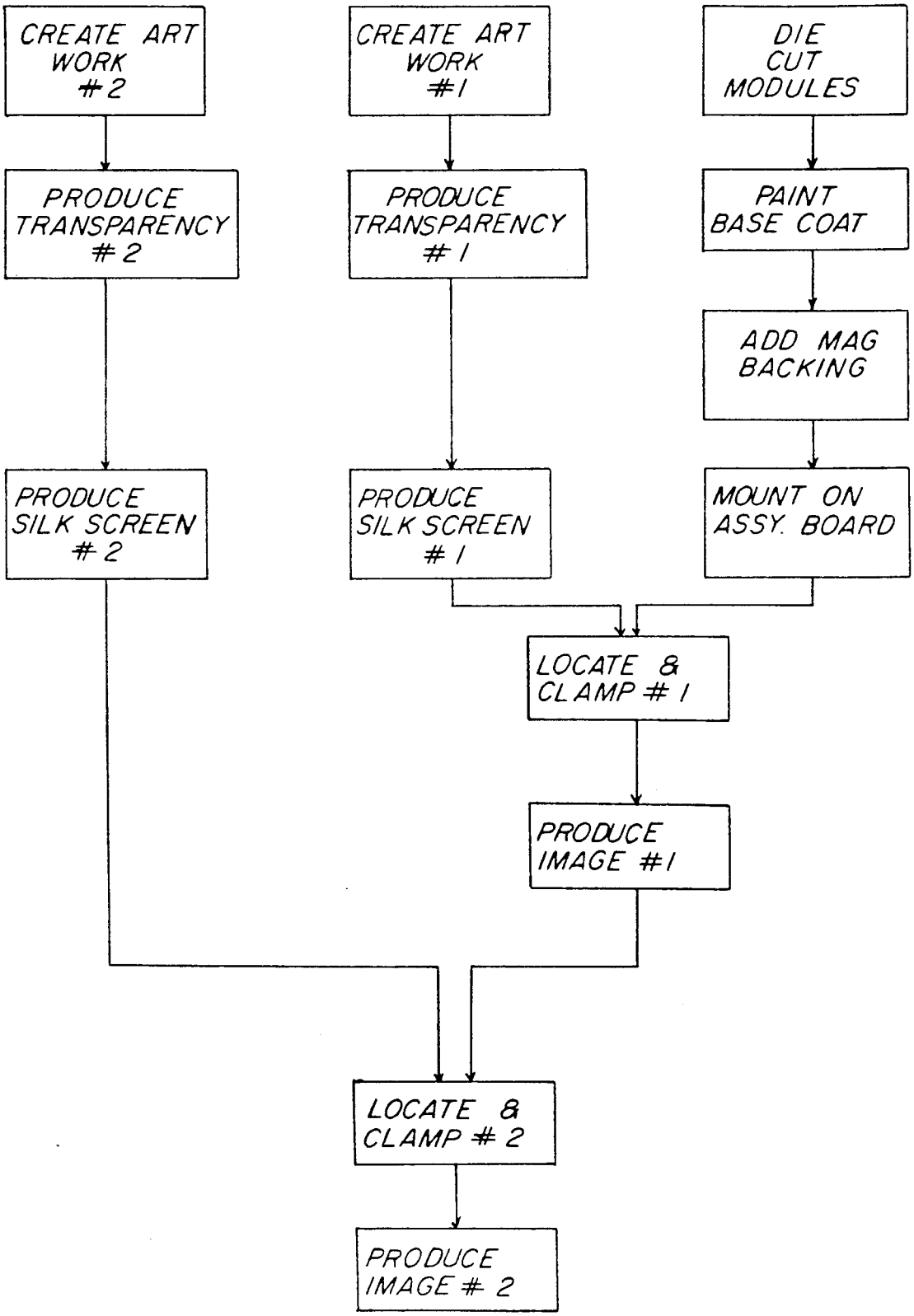
FIG. 9 is a flow chart for production of a module.

Referring now to FIG. 9, it will be seen that blank modules are produced by the series of steps which have been outlined above. Then they are mounted on an assembly board which may have a steel face. The blank modules may be magnetically adhered to such a steel face in edge-to-edge contact so as to define a closed matrix such as they will occupy on the finished display board.

After the modules are mounted on the assembly board the desired graphics are silk screened thereon. Generally a utility company possesses printed maps of its distribution area. These maps may be photographed to produce transparencies which in turn can be exposed to produce corresponding silk screens. Alternatively, the image information may be digitized and computer plotted directly onto transparent or translucent film for use in silk screen production. The silk screens may be clamped in place on the assembled blank modules, and ink or paint may be pulled across the screen mesh and forced therethrough in the conventional manner to produce high quality silk screened images.

In general it may take several silk screens to cover the area of the assembled blank modules, which may be in the order of 96 sq. ft. (8'×12'). If a number of such silk screens are required for production of a single image, they may be aligned, clamped and used in sequence. FIG. 9 refers to all such silk screens associated with production of a single image in connection with the series of boxes labeled Create Art Work No. 1, Produce Transparency No. 1, Produce Silk Screen No. 1, Locate and Clamp No. 1 and Produce Image No. 1.

It often happens that the user of display board 10 desires to display superimposed images having different degrees of permanency. For instance, a power company may wish to display relatively permanent geographical background features and superimpose thereon graphical foreground representations of power lines and switches which are subject to change from time to time. Such a two-step process is illustrated graphically in FIGS. 5 and 6.

Figure 5:
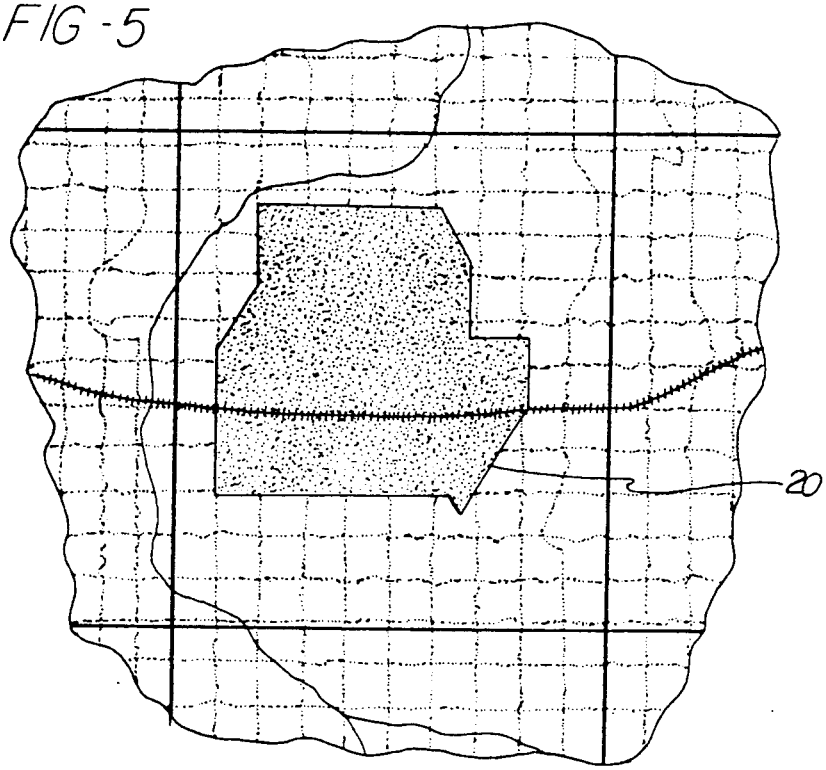
FIG. 5 is a schematic representation of a portion of a module having permanent background features silk screened thereon.
Figure 6:
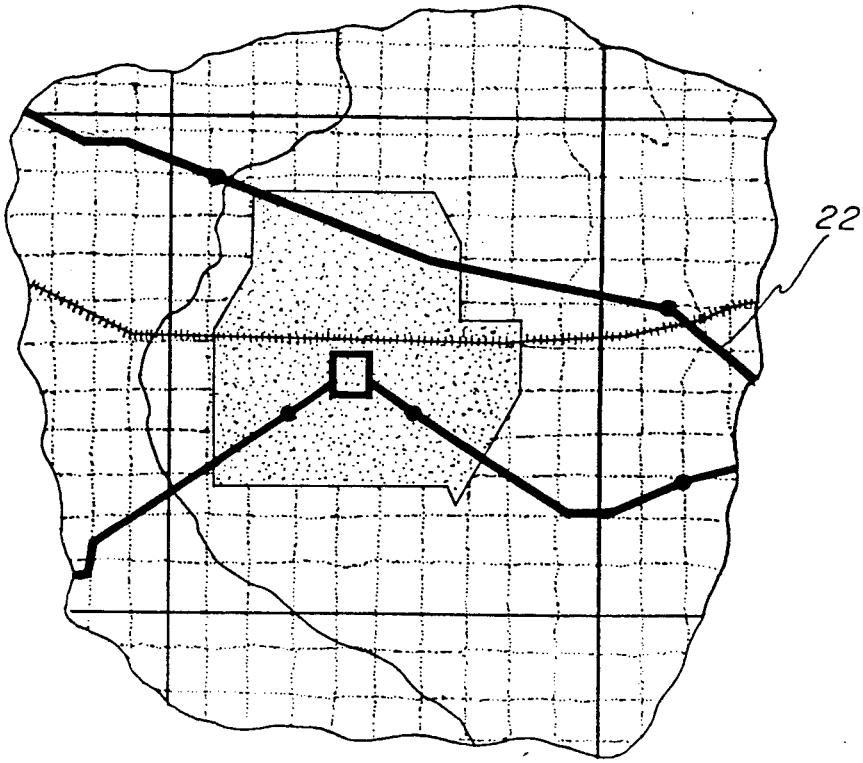
FIG. 6 is an illustration similar to that of FIG. 4 but with the addition of a second silkscreen pattern illustrating power distribution equipment.

FIG. 5 illustrates a portion of the surface of a module 12 after application of background graphics 20. Such background graphics may include municipal boundaries, streams, highways, etc. After these background graphics have been printed, foreground graphics 22 may be overprinted thereon, as illustrated in FIG. 6. The sequence of steps related to the printing of the foreground graphics 22 are depicted in FIG. 9 by the series of blocks captioned Create Art Work No. 2, Produce Transparency No. 2, Produce Silk Screen No. 2, Locate and Clamp No. 2 and Produce Image No. 2.

The general technique for producing the foreground graphics is the same as followed for the background graphics. However, the printing medium is different. For instance, the background graphics may be printed using a lacquer base silk screen ink. This ink has a relatively permanent nature. For the foreground graphics it may be convenient to use an enamel base silk screen ink which may be erased by applying any one of a number of commercially available enamel solvents. This enables the user to remove power lines or switches which have been moved, without affecting background graphics 20. The new equipment may be displayed upon the appropriate modules by hand painting, silk screening or a dry transfer process. In some cases it may be desired to display portions of the background graphics 20 or foreground graphics 22 in different colors. This is easily accomplished by repeating the Image No. 1 steps or the Image No. 2 steps for different graphics and using ink of a different color.

Figure 7:
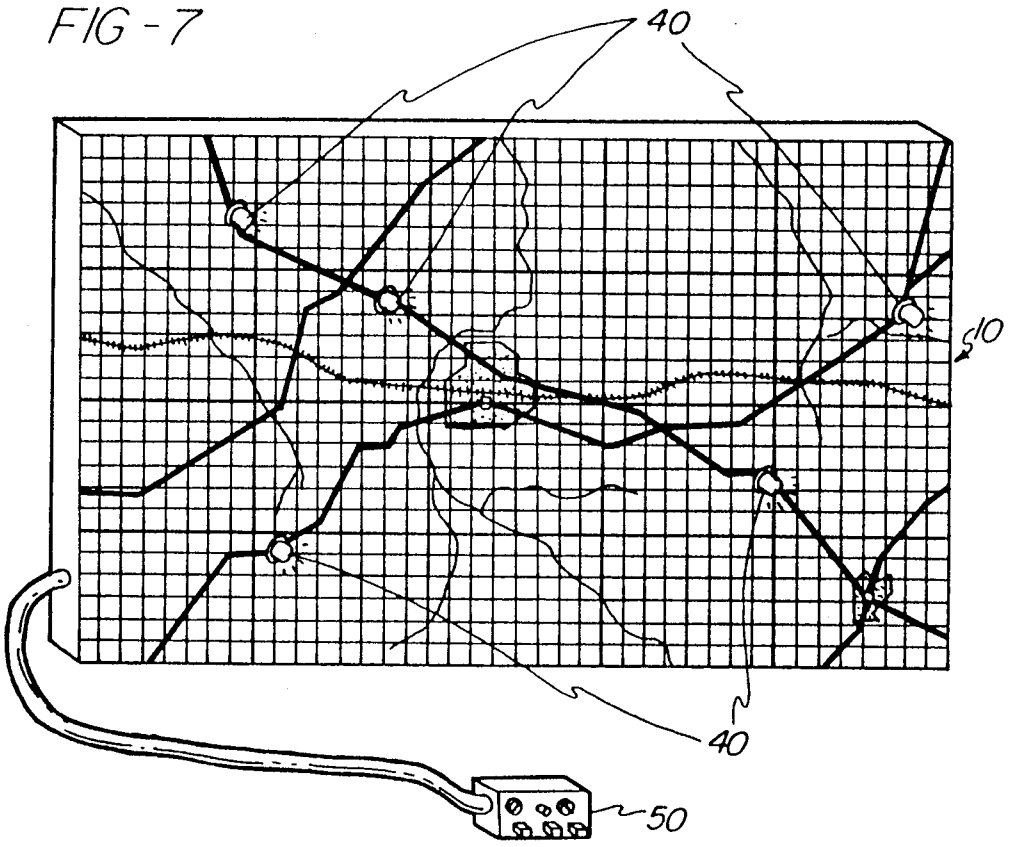
FIG. 7 is a perspective view of a modular power system mapboard including light emitting diodes.
Figure 8:
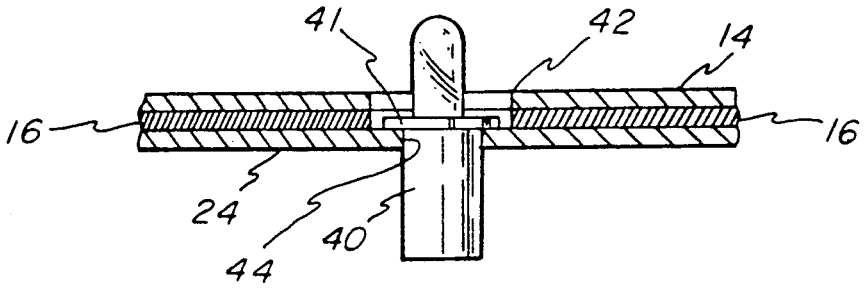
FIG. 8 is an enlarged cross-sectional view of an LED mounting.

In an alternative embodiment, display board 10 may be fitted with a series of light emitting diodes 40, as illustrated in FIGS. 7 and 8. LEDs 40 may represent switches in an electrical power distribution system. They may be connected to a controller 50 for individual activation to illustrate the status of switches in the network. LEDs 40 may have a dual color capability to indicate different switching states and may be programmed to flash as desired. LEDs 40 conveniently may be installed after display board is in place. Thereafter a series of apertures 44 are bored through modules 12 and support board 24 at appropriate locations. Apertures 44 have a diameter equal to or slightly smaller than the diameter of LEDs 40, so that the LEDs may be press-fitted into place. Enlarged openings 42 may be created in modules 12 surrounding apertures 44 to accommodate a lip 41 on each LED 40.

It will be appreciated that modules 12 need not be rectangular but may have other geometrical configurations, such as hexagonal, without departing from the scope of this invention. Also, magnetic sheet material could be applied to the surface of support board 24, thereby avoiding the need to provide backing sheet 16 on modules 12. Other lesser preferred embodiments could use hook and loop fastening material rather than magnetic backing sheets for securing modules 12 to frame 30.

While the process and product herein described constitute preferred embodiments of the invention, it is to be understood that the invention is not limited to this precise process and product, and that changes may be made therein without departing from the scope of the invention which is defined in the appended claims.

What is claimed is:

1. A display board for a utility distribution system comprising:

(a) a support surface for supporting a matrix of display modules, (b) a plurality of rows and columns of precisely dimensioned, rectangular steel display modules, approximately $8\frac{1}{2}'' \times 11''$ in size and positioned in tightly fitting relationship upon said support surface; said modules being coated on their outwardly facing surfaces by a print receptive base coating and being sufficiently flexible to accommodate curvature of said support surface, (c) magnetic attraction means for releasibly securing said display modules to said support surface, (d) a geographical background pattern imprinted upon said modules on top of said base coating, such that said modules in properly assembled relationship cooperatively display a map of the region of said distribution system, and (e) a foreground pattern of utility system distribution components imprinted on said modules directly upon said map.

2. A display board according to claim 1 wherein said display modules comprise coated galvanized sheet steel of approximately 24 gauge thickness.

3. A display board according to claim 1 wherein said foreground pattern comprises a representation of power lines and switches.

4. A display board according to claim 3 wherein at least some of said modules are provided with apertures in alignment with apertures in said support surface, said display board further comprising light-emitting means mounted in said aligned apertures and control means for selectively activating said light-emitting means to portray status information relating to said distribution system.

5. A display board according to claim 4 wherein said magnetic means comprises sheets of magnetic rubber adhesively secured to said modules on the surfaces thereof facing said support board; said support surface comprising a support board fabricated from a ferrous material.

6. A display board according to claim 3 wherein said sheet steel has a thickness of approximately 24 gauge.

7. A display board according to claim 6 wherein said magnetic material comprises magnetic rubber sheet material.

8. A display board according to claim 1 wherein said background pattern is silk screened upon said modules in a relatively permanent ink and said foreground pattern is overprinted upon said background pattern in a printing medium which may be removed without disturbing said background pattern.

9. A display board according to claim 1 wherein said display modules comprise die cut sheet steel.

10. A display board according to claim 9 wherein said display modules are galvanized.

11. A display board according to claim 1 wherein said support surface is curved.

12. A display module comprising:

(a) a rectangular steel plate of sufficient flexibility for magnetically induced conformance to a curved support surface and having lateral dimensions of approximately $8\frac{1}{2}'' \times 11''$, said plate being die cut for mounting on said support surface in tightly fitting relationship with other such plates, (b) a hardened base coating on said plate, (c) a geographical background pattern printed upon said base coating, said background pattern being part of an area map which may be visually observed when said plate is mounted as aforesaid within a matrix of other such plates printed with other parts of said map, (d) a foreground pattern of utility system distribution components directly printed upon said background pattern, and (e) a layer of magnetic rubber material adhesively secured to said plate opposite said base coating.

13. A display module comprising:

(a) a rectangular steel plate of sufficient flexibility for magnetically induced conformance to a curved support surface and having lateral dimensions of approximately $8\frac{1}{2}'' \times 11''$, said plate being die cut for mounting on said support surface in tightly fitting relationship with other such plates, (b) a hardened base coating on said plate, (c) a geographical background pattern being part of an area map which may be visually observed when said plate is mounted as aforesaid within a matrix of other such plates printed with other parts of said map, and (d) a foreground pattern of utility system distribution components directly printed upon said background pattern; said plate being provided with at least one aperture for reception of light-emitting means displaying status information for said distribution system components.

14. A display module comprising:

(a) a rectangular steel plate of sufficient flexibility for magnetically induced conformance to a curved support surface and having lateral dimensions of approximately $8\frac{1}{2}'' \times 11''$, said plate being die cut for mounting on said support surface in tightly fitting relationship with other such plates, (b) a hardened base coating on said plate, (c) a geographical background pattern printed upon said base coating, said background pattern being part of an area map which may be visually observed when said plate is mounted as aforesaid within a matrix of other such plates printed with other parts of said map, and (d) a foreground pattern of utility system distribution components directly printed upon said background pattern in a relatively removable medium which may be removed from said module without disturbing said background pattern.

15. A display module according to claim 14 wherein said background pattern is silk screened upon said base coating.

* * * * *